US009517816B2

(12) United States Patent
Mueller

(10) Patent No.: US 9,517,816 B2
(45) Date of Patent: Dec. 13, 2016

(54) STERN HATCH MEANS

(76) Inventor: Peter A. Mueller, Gattikon (CH)

( * ) Notice: Subject to any disclaimer, the term of this patent is extended or adjusted under 35 U.S.C. 154(b) by 153 days.

(21) Appl. No.: 13/806,464

(22) PCT Filed: Jun. 20, 2011

(86) PCT No.: PCT/CH2011/000150

§ 371 (c)(1),
(2), (4) Date: May 8, 2013

(87) PCT Pub. No.: WO2011/160247

PCT Pub. Date: Dec. 29, 2011

(65) Prior Publication Data

US 2013/0220207 A1 Aug. 29, 2013

(30) Foreign Application Priority Data

Jun. 21, 2010 (CH) ..... 990/10

(51) Int. Cl.
*B63B 17/00* (2006.01)
*B63B 27/14* (2006.01)

(52) U.S. Cl.
CPC ..... *B63B 27/14* (2013.01); *B63B 27/146* (2013.01)

(58) Field of Classification Search
CPC ..... B63B 27/146; B63B 27/14; B63B 27/143; B63B 2027/141; B63B 17/00; B63B 27/36; B63B 23/32
USPC ..... 114/362
See application file for complete search history.

(56) References Cited

U.S. PATENT DOCUMENTS

| | | | |
|---|---|---|---|
| 5,690,045 | A | 11/1997 | Gauthier |
| 6,327,992 | B1 | 12/2001 | Martin |
| 6,789,648 | B2 | 9/2004 | Cook |
| 7,121,226 | B2 | 10/2006 | Grimaldi |
| 7,293,521 | B1 | 11/2007 | Johns, Jr. et al. |
| 2011/0017119 | A1 | 1/2011 | Muller |

FOREIGN PATENT DOCUMENTS

| | | | |
|---|---|---|---|
| DE | 196 02 331 | A1 | 7/1997 |
| DE | 20 2009 007 140 | U1 | 10/2009 |
| EP | 1 854 715 | A1 | 11/2007 |
| WO | WO 2009/097706 | A2 | 8/2009 |

OTHER PUBLICATIONS

Nov. 22, 2011 International Search Report issued in International Patent Application No. PCT/CH2011/000150.

*Primary Examiner* — Anthony Wiest
(74) *Attorney, Agent, or Firm* — Oliff PLC

(57) ABSTRACT

The invention relates to a foldout stern-lowering means (1) which constitutes an integral part of the watercraft (38) and has at least three sectors (A, B, C) which can be walked on and optionally three further sectors (D, E, F) which can be walked on, with three different foldout modes: gangway, stairs and tender, with a safety means on the lifting means (18) in order always to return the stern-lowering means (1) into the starting position, and a safety means by means of an emergency lifting means (31) for people, and also to compensate for the additional weight of a stern-lowering means (1) by means of buoyancy means (39, 39*a*) and to increase the comfort while underway and before anchoring, assisted by slosh plates (40).

8 Claims, 3 Drawing Sheets

STERN HATCH MEANS

TECHNICAL FIELD

The invention relates to a foldout stern-lowering means for allowing people safe access to land and to water by means of steps, on the one hand, as well as for allowing a tender comfortable access to land and water by way of a ramp function according to the preamble of the first claim, on the other hand.

PRIOR ART

Foldout lowering or otherwise adjustable staircases are known in the art, wherein technically optimally engineered staircases are found in the marine context, which are, moreover, usually extended by a motor, with the steps of the staircases being in most instances adjustable. The step adjustment therein is achieved by external push rods or chains.

Lowerable platforms, especially for swimmers, divers and tender craft are known in the art, as disclosed in specifications DE196 02 331, U.S. Pat. No. 6,327,992 and U.S. Pat. No. 5,690,045. They allow for lowering persons or material comfortably into the water or take them onboard from the water.

Also known are horizontal foldout stern components that serve as bathing platform or support for lifting and lowering tender boats.

On yachts, even stairs that are extended from the belly of the watercraft or the swimming platform are known, as disclosed, for example, in specifications U.S. Pat. No. 6,789,648 B2, or components of the swimming platform that are lowered into the water in an arc and that have disposed thereon staircase elements, as disclosed in specification U.S. Pat. No. 7,121,226 B2, or means to lower tenders to water using the classic lowering means and additional tender supports with trailer, as disclosed in specification U.S. Pat. No. 7,293,521 B1.

DESCRIPTION OF THE INVENTION

The object of the present invention seeks to provide a means on a watercraft that is simultaneously an integral component of the external contour of the watercraft while providing the user and a tender of the watercraft with safe and comfortable access to land and to water.

Comfortable boarding and deboarding aids for persons and tenders are offered primarily for large yachts, where the weight and the complexity of handling such devices is an order of magnitude of subordinated importance, often being part of the lifting construction for tenders and/or garages.

Due to the extra cost and weight, such comfort constructions are not available for smaller boats and yachts, because the stability of any such a construction may not be less therein than on large systems; plus, handling must be easier and safer by a multiple factor, as smaller yacht or boat owners must handle all tasks themselves and still keep an eye on safety, an aspect of even more critical importance in the leisure sector, since users here lack a handling routine.

Furthermore, safe and comfortable access to and from the water is not only to be provided to people but also for tender boats and other technical equipment. At the same time, going on shore is to be rendered safe by utilizing the same means as a gangway.

The invention takes advantage, on the one hand, of swimming platforms, which are in most instances already integrated in the boat design, as well as the highly placed back panels on the stern of yachts—increasingly also seen on medium sized boats—as part of the foldout stern-lowering means, which can be used on the inside—in the foldout state therefore constituting the visible side—as a gangway, when opened half-way, in that the inside of the swimming platform includes steps, the inside of the stern section is a walkway constituting, when being folded out further, a swimming platform with the highly place back panel of the stern becoming a staircase. Correspondingly, the foldout mechanism ensures that the staircase remains fixedly connected to the body of the boat, thus increasing the solidity of such a pivoting means. Any upward spraying of water on exteriorly positioned swinging arms is omitted; and in places without swinging arms, nothing can corrode and no weight is added, which is a further advantage of such a foldout version. The boat can also benefit, moreover, from an aesthetic point of view, because the construction can be incorporated in the overall design of such a watercraft.

The foldout action is implemented by an electrical or hydraulic motor or operating cylinder, supported by one or a plurality of gas springs that also serve as emergency lifters. If there is an electrical failure in the onboard system, or a leak in the hydraulic lines, the folded out stern part can, nevertheless, still be raised and moved to the starting position, meaning as part of the back panel of the stern of a watercraft, using a breaking effect.

The foldout operation includes three basic foldout modes, namely the gangway, stair and tender positions, with the latter acting as a ramp for lowering and retracting the tender or tender trailer, respectively. It is understood that any intermediate positions located there between can be reached and stopped at, a function that is particularly important for the gangway mode in order to be able to adjust the correct angle for going on land.

If necessary, not only the stern hatch means must be folded back; in the event that a person goes overboard, time is of the essence and quick action is needed, either by means of the emergency switch that is installed below the swimming platform for folding out the stern lowering means, or by means of a pivotable staircase with holding bars attached thereto and a lock at the end of the lift, such that any person in the water is able to climb the stairs as well as lift his/herself out of the water by their own strength, thus simplifying coming back onboard considerably. The pivot process can be additionally supported by a spring.

The additional weight in the stern of a watercraft may place a load on the trim of the craft. Buoyancy units are therefore fastened below the stern hatch means or the swimming platform, respectively, that correct the static trim, on the one hand, and improve the economy of the craft during travel, on the other hand, due to the hydrodynamics of the laterally attached buoyancy units that include, in addition, steps in the floor areas thereof; when anchored, the slosh plates, which can even connect the buoyancy units to each other, are able to thus reduce any rolling and pitching of the craft, when it is stationary while, nevertheless, not interfering with the current against the craft during travel. Moreover, the buoyancy bodies are height-adjustable and inflatable, thereby changing the volume conditions in the area of the stern of the watercraft, providing correspondingly the desired buoyancy. The additional weight of such stern-lowering means can be relayed to the stern of the watercraft such as, for example, by means of supports directly mounted on the lift motor housing. In addition, the swimming platform can be supported thereon, as well as the lateral buoyancy units.

According to the invention, this is achieved by the characterizing features of the first claim.

The core of the invention provides by means of a foldout stern-lowering means, which constitutes an integral part of the watercraft for embodying a simple and very comfortable staircase for persons or a ramp for a tender, and for said staircase having the capacity to be used, by way of additionally integrated stairs, as a gangway. Safety means on the mechanics and personal rescue devices improve the product quality, and the rigid or adjustable buoyancy units with slosh plates improve the comfort of the watercraft during anchoring as well as travel.

Further advantageous embodiments of the invention can be derived from the dependent claims.

BRIEF DESCRIPTION OF THE DRAWINGS

Embodiments of the invention will be illustrated in further detail based on the drawings below. Same elements in different figures are identified by identical reference signs.

Shows are as follows.

Only elements that are essential for an immediate understanding of the invention are presently shown.

WAYS TO EMBODY THE INVENTION

Figure 1:
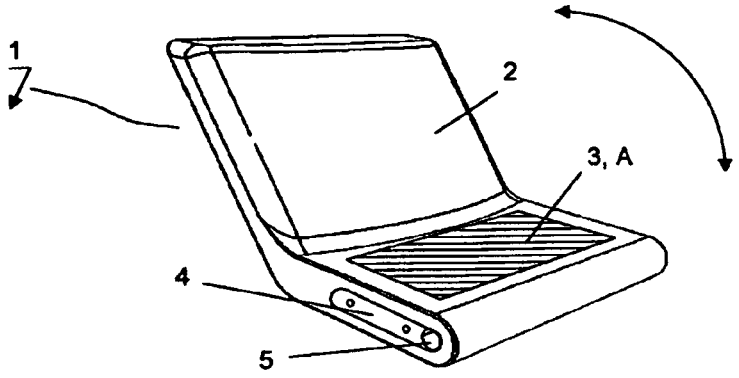
FIG. 1 shows a schematic, three-dimensional view of an offset stern-lowering means for a watercraft, with a back panel matched to the vehicle having a lifting element and a pivot bearing device fastened thereto.

FIG. 1 shows a schematic, three-dimensional view of an offset stern hatch means 1 for a watercraft having a back panel 2 matching the craft, a standing area 3, and laterally mounted thereto lever element 4 and a pivot bearing device 5.

The stern hatch means 1 is an integral component of a stern on a watercraft that can be unfolded using a motor or manually, and that has the known quality surface on the standing area 3 such as, for example, a teak flooring or a plastic anti-slip liner, and the like. If possible, the stern hatch means 1 should be a light-weight component with the hollow spaces filled by a closed cell foam material. The pivot bearing device can be continuous in order to reinforce the entire construct; similarly, the lever element 4 can be a continuous frame around the stern hatch means 1 that helps to reinforce the component. The stern hatch means 1 has a form and utility that is equal to a swimming platform, due to the standing area 3.

Figure 2:
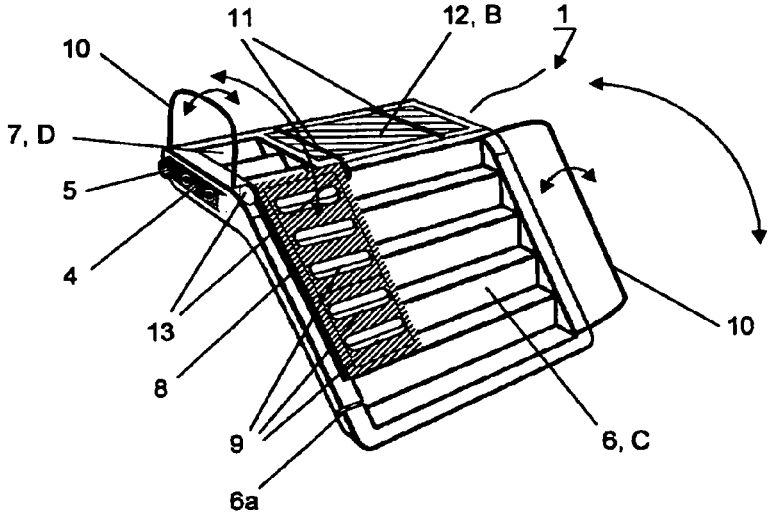
FIG. 2 shows a schematic, three-dimensional view of a folded out, offset stern-lowering means, with an integrated staircase having a staircase recessed therein as gangway means, with a foldout element having recessed steps therein and a foldout hand rail, as well as a rail element set.

FIG. 2 shows a schematic, three-dimensional view of a folded out, offset stern-lowering means 1 having an integrated staircase 6 with water run-off **6*a* and a recessed gangway staircase 7 as gangway means, with a foldout element 8 having recessed steps 9 therein and a foldout hand rail 10, as well as runner element set 11 at the head standing area 12**.

Folding out the stern hatch means 1 by 180°, if possible using a motor, the staying area in the stern of the watercraft is virtually doubled, on the one hand, due to the gangway staircase 7 that is covered up in this position by the foldout element 8, which is provided with hinges 13, and, on the other hand, by the head standing area 12. Access to and from the water is provided via the generous staircase 6 that can be almost as wide as the width of the watercraft. Due to this generous staircase configuration, it is advantageous to be able to utilize a hand rail 10 that can be unfolded laterally and locked into place on the staircase 6 (not shown here); or with the same applying to a gangway staircase 7 as well. The foldout element 8, which includes cutouts that can be used as steps, can be extended in the telescopic or foldable version beyond the end of the staircase 6, thus allowing tall swimmers even more convenient access to the staircase 6.

If the stern hatch means 1 is unfolded, for example, only by 135°, this constitutes an access way by means of the gangway staircase 7 upon which it is now possible to utilize the foldout element 8 that is folded on the side of the staircase 6 and that can be used as horizontal gangway. In the telescopic version, the foldout element 8 can be a path which can be walked on beyond the stern hatch means 1. The foldout element 8 can be raised via a wedge means, such that it is possible to gain easy land access even to higher terrain.

The stern hatch means 1 can also be unfolded over 180° in order to let a tender to water or pull the same up again. This occurs by means of a runner craft that is advantageously routed inside the runners 11. A runner craft of this kind thus always stays in the tack with the tender thereof, and it is possible to correspondingly trigger the same electronically, and it is unable to become detached from the track.

Upon immersing the stern hatch means 1 complete with the integrated staircase 6 thereof in the water, it is extremely advantageous for well-placed water run-offs **6*a* to be present; otherwise the stern hatch means 1 with the staircase 6 thereof acts as an excavator bucket whereby much water is lifted, weighing heavily, and pouring over the stern of the watercraft when the stern hatch means 1 is folded together. Such water run-offs 6*a* can, on the one hand, be mounted directly on the side of the staircase 6 and, additionally, be hidden inside the stern hatch means 1** as elegant water run-off tubes, such that they direct the water away in a manner that is barely visible or audible, for example near the water line in the stern of the watercraft.

Correspondingly, the stern hatch means 1 is multifunctional in the different positions—in the closed state, by way of standing area 3, it has sector A which can be walked on; in the opened state, by way of head standing area 12, it has sector B which can be walked on; by way of staircase 6, it has sector C which can be walked on; by way of gangway staircase 7, it has sector D which can be walked on; and by way of extendable foldout element 8, it has a further walkable area.

Figure 3:
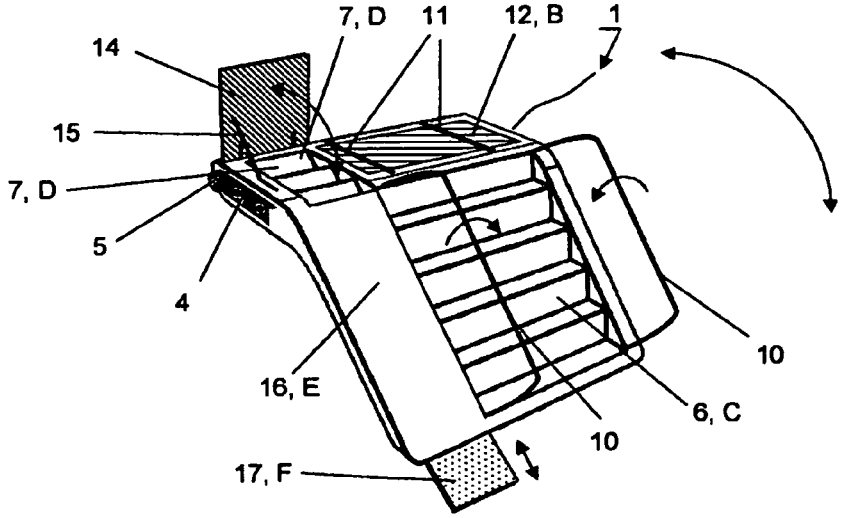
FIG. 3 shows a schematic, three-dimensional view of a folded out, offset stern-lowering means, with an integrated staircase having a staircase recessed therein as gangway means and a surface that can be walked on, as well as a foldable cover element and foldout hand rails.

FIG. 3 shows a schematic, three-dimensional view of an unfolded, offset stern-lowering means 1 with integrated staircase 6, with recessed gangway staircase 7 as gangway means, with a hatch element 14 having a spring 15 and a walking area 16 that has an extendable extension 17, and a second, parallel foldout hand rail 10, as well as runner element set 11 on the head standing area 12.

The function is identical as in FIG. 3, with the exception that the staircase 6 is not configured as being quite as wide in this case; instead, a part thereof is reserved for the walking area 16, sector E which can be walked on and can simultaneously include an integrated extendable extension 17, and which is walkable sector F. The walking area 16 and the extendable extension 17 can include high-value surface materials matching the craft, and the extendable extension 17 can also include steps 9. The walking area 16 can also be varied in terms of the incline thereof relative to staircase 6 similarly to the stern hatch means 1, such that a very precise adjustment of the desired height can be achieved for going on land. When the stern hatch means 1 is closed, it is possible for the hatch 14 to be connected to the craft or the swimming platform there below using a hook-and-loop means, or magnets or a ratchet-and-pawl mechanism, or a locking element that can be electrically actuated, or the like. When the stern hatch means 1 is folded up, for example, by 135°, the hatch element 14 adheres to the ground below and does not fold up as well, whereby the stern hatch means 1 automatically includes a gangway staircase 7 leading to walking area 16. If the stern hatch means 1 is folded out further to 180°, the foldout angle is too great for the folding element 14, it detaches from the ground below, and it is pulled shut by means of spring 15, for example a gas tension spring, whereby the gangway staircase 7 is automatically covered, such that an even larger surface is achieved for the head standing area 12, walkable sector B.

Figure 4:
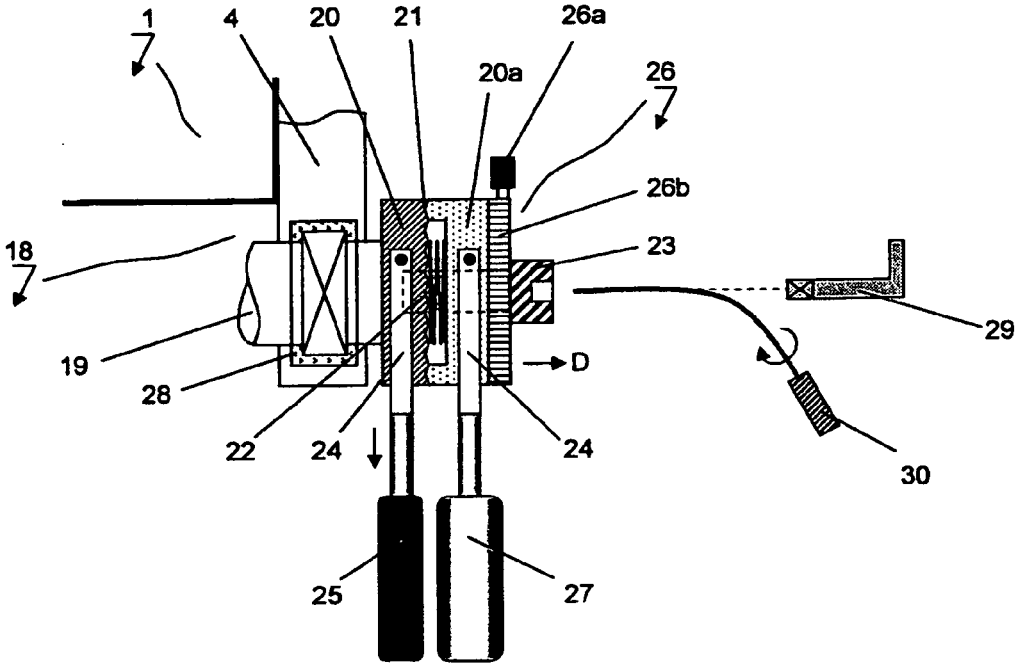
FIG. 4 shows a schematic side view of a lifting means that includes a lift motor with block on a connecting wheel, and a further connecting wheel with mounted gas spring, as well as a shaft which, by means of spring damping, can be connected to a lever element on which is mounted the offset stern-lowering means, and a connecting screw that that compresses the two connecting wheels against a spring, which can be released manually or by remote control.

FIG. 4 shows a schematic side view of a lifting means 18 that holds the stern hatch means 1 via the lifting element 4, and a shaft 19 is mounted on the lifting element 4 with a rubber bearing 28 disposed there between, and the shaft 19 is connected to a connecting wheel 20. By means of a slotted toothing 21, or the like, the connecting wheel 20 is connected to a further connecting wheel **20*a* that also includes a slotted toothing 21, whereby the connecting wheels 20, 20*a* are fixedly connected to each other by means of a compression spring 22 and mounting screw 23 disposed there between. A load band 24 is fastened to the connecting wheel 20 that engages with a gas spring 25 and on connecting wheel 20*a*, additionally having a block 26, there is mounted a further load band 24, which engages on the lift motor 27. The two connecting wheels 20 and 20*a* can be separated from each other by means of a manual tool 29 or a remote control 30**.

The lifting means 18 is a central factor in the implementation of a safe operation of the stern hatch means 1, as, even in a light-weight construction, the large-surface stern hatch means on a yacht can still be a heavy part. The torques for the hatch movements can thus be considerable; the safety of such a movable part must take high priority, as well as security of function, even in the event of a failure of the electrical supply on the lift motor 27, such that the stern hatch means 1 can be safely folded shut at any time and without great force expenditure.

Therefore, the lifting means 18 is made of two drive mechanisms, namely the gas spring 25, which is responsible for providing a correspondingly lifting power, and the lift motor 27, which must also provide a corresponding lifting power, such that the gas spring 25 and lift motor 27 acting in conjunction virtually provide a double lifting power; meaning, respectively, the lift motor 27 and the associated transmission must only have half the force in order to generate a corresponding torque. A second corresponding control of the gas spring 25, which is presently not shown, is tasked to act as a brake during the folding operation over the vertex point; similarly, the lift motor 27 is also able to execute a braking function. The lift motor 27 can be actuated hydraulically or electrically; it can be self-decelerating or be held in a desired position by means of an additionally installed block 26, even in high waves or with corresponding loads acting on the stern hatch means 1 in the gangway position. The block 26 includes a lifter **26*a* and a toothed disk 26*b***.

If the lift motor 27 and the electrical block 26 fail, locking can be circumvented in order to detach the connecting wheel **20*a* from the connecting wheel 20, which was locked unintentionally, in that the mounting screw 23 is loosened whereby the compression spring 22 axially presses the connecting wheel 20*a* to the outside, as indicated by arrow D, possibly together with lock 26, such that the two connecting wheels 20,20*a* ultimately no longer touch, and the connecting wheel 20 can rotate freely, meaning powered by gas spring 25. The connecting wheel 20 is connected to shaft 19 and gas spring 25; the stern hatch means 1 thus raises itself over the vertex point of the hatch motion and is decelerated by the same gas spring 25 or a second gas spring 25 or an oil damping or another braking means, and the stern hatch means 1 can thus be gently folded back into the original position thereof. The mounting screw 23 is loosened either manually using a hand tool 29 such as, for example, an Allen wrench or via a remote control 30** that is can be activated by means of a cordless screwdriver.

The rubber bearing 28 between shaft 19 and lifting element 4 serves for cushioning should the stern hatch means 1 come in contact with the landing planks, when it is in the gangway position, thus absorbing the impact energy. Instead of a rubber bearing 28, another means for limiting torque are conceivable as well.

Figure 5:
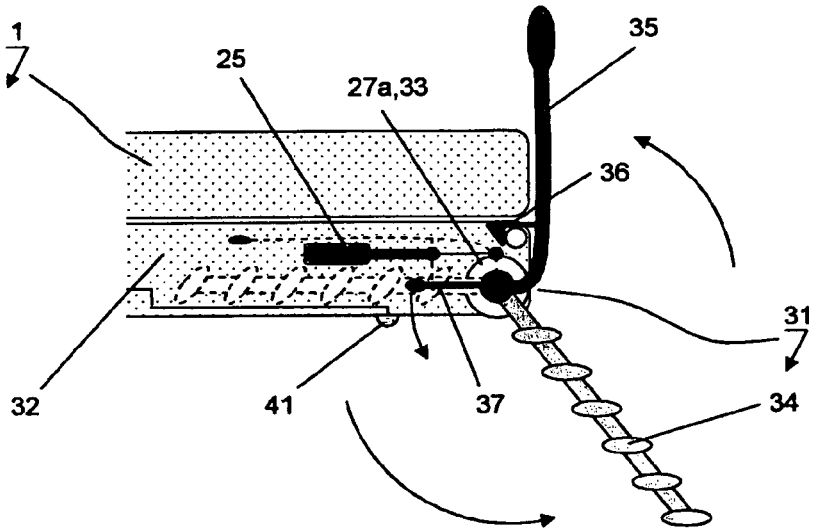
FIG. 5 shows a schematic side view of a emergency lifting means that is mounted on the swimming platform and that includes an emergency lift motor plus a spring with an auxiliary transmission for the manual lever and as a lock.

FIG. 5 shows a schematic side view of an emergency lifting means 31 that is mounted on the swimming platform 32 and includes an emergency lift motor **27*a* with auxiliary transmission 33, thus actuating the step ladder 34 and, simultaneously, the hand rail 35 by a lock 36 mounted thereto. In order to not rely on the emergency lift motor 27*a*, the lever 37 is mounted on the emergency lifting means 31 in order swing out the step ladder 34 manually. For eventualities, an emergency switch 38 is provided under the swimming platform 32, such that a person can operate the stern hatch means 1** from the water to bring the same in the foldout mode.

Emergency ladders are obligatory for watercraft of certain sizes; if a person goes overboard, it is thus possible for such a person to come back on board using such an emergency ladder. It is often difficult to open such emergency means, and often there are no holding possibilities provided on the swimming platform 32 for a person to climb out of the water and come back onboard by his or her own power. Folding out the stern hatch means 1 can also take too long when a person in the water is frantically searching for rescue, although a water-proof emergency switch 38 is located below or on the swimming platform 32 by which the person who went overboard is able to activate the stern hatch means 1, thereby unfolding the same.

The emergency lifting means 31 mounted below the swimming platform 32 includes a swing-out step ladder 34, powered by the emergency lift motor 27*a*, provided with an auxiliary transmission 33, that swings out, by a gear ratio step up, the hand rail 35 simultaneously with the former in the same direction, such that when the step ladder 34 has reached the desired position thereof, the hand rail 35 has also reached the desired position thereof. The lock 36 ensures that the hand rail 35 remains in the desired position, even when a person pulls on it while climbing up the same. This makes the climbing process much easier and thus also safer. The actuation of the switch—presently not shown—occurs in that the person in the water pulls on the step ladder, thus triggering the contact; and/or an auxiliary emergency switch is mounted on the stern of the watercraft and activated by a third party. If the emergency lift motor 27*a* also fails during the emergency, a lever 37 is attached to the same that has the same function as represented in FIG. 4 regarding the mounting screw 23, such that the step ladder 34 is detached from the emergency lift motor 27 and able to swing freely downward. The auxiliary transmission 33, however, remains functional, meaning the hand rail 35 is also extended. Instead of as described in FIG. 4, the emergency lifting means 31 is not retracted but, upon release by the lever 37, the step ladder 34 is automatically extended completely using the gas spring 25 or spiral spring, and the like, such that the emergency lifting means 31 is swung out and the step ladder 34 and hand rail 35 are automatically locked at the point of the stop, specifically without the person in the water having to do anything.

Figure 6:
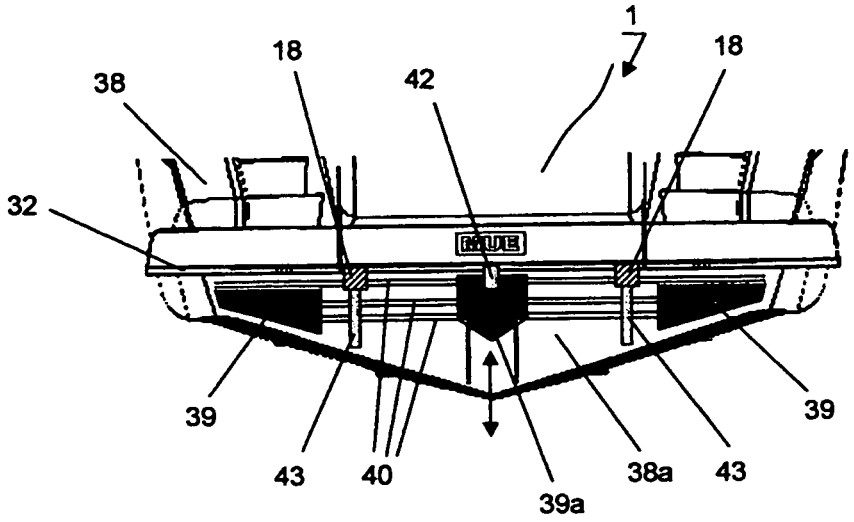
FIG. 6 shows a schematic view of the stern of a watercraft with supports as well as rigid and adjustable buoyancy units and slosh plates.

FIG. 6 shows a schematic view of the stern of a watercraft 38 with a closed stern hatch means 1, the lifting means 18, the supports 42, as well as the buoyancy units 39 and a height-adjustable buoyancy unit 39*a* as well as slosh plates 40.

Additional weights on the stern 38*a* of a watercraft 38 can cause trimming of the craft, meaning, respectively, the craft is permanently weighed heavier in the stern, lying unevenly in the water. The use of buoyancy units 39 in connection with the stern hatch means 1 makes sense because the buoyancy units 39 do more than compensate for extra weight in that they provide useful services in terms of hydrodynamics as well; especially with a stepwise floor, now shown here, they improve the driving properties of a watercraft 38 considerably. Moreover, they have a stabilizing effect, when the watercraft 38 is anchored.

With a foldout stern hatch means 1 of this kind, the lever arm changes unfavorably to the rear during the folding-out operation. To compensate for this situation, optimum buoyancy is helpful, which only becomes active when the stern hatch means 1 is immersed in the water, as well as the light-weight construction of the stern hatch means 1 and an extendable or inflatable buoyancy unit 39*a*, which is located, for example, in the middle part on the stern 38*a* and enlarges the buoyancy volume in the water parallel to the amount that the watercraft 38 becomes weighted to the stern area due to the unfolding of the stern hatch means 1. This can be monitored and corrected by means of position sensors and a controller, or a fixed algorithm that detects the foldout angle and provides in this regard each time a predetermined buoyancy volume in that the lowerable buoyancy unit 39*a* that is in as much as possible above the waterline in the resting state is now immersed below into the water, whereby additional volume is generated translating to buoyancy in the area of the stern 38*a*, whereby the shifted weight of the stern hatch means 1 is counteracted; or the buoyancy unit 39*a* is inflatable and a corresponding air volume is introduced in order to achieve additional buoyancy volume in this manner. During travel, the buoyancy body 39*a* is refolded or retracted. Lowering and retracting occurs vertically or in the shape of an arc using an operating cylinder 42, or it is subject to a forcible control by means of a presently not shown linkage that is connected to the stern hatch means 1.

Furthermore, it is advantageous for the swimming platform 32 to be reinforced by mounting support elements 43 that act simultaneously with the lifting means 18, such that, ultimately, the load acting in the area of the stern hatch means 1 can be additionally further distributed via the support elements 42 over the stern 38*a*. The support elements 42 therein can also include additional expedient supports on the inside of the watercraft 42.

Slosh plates 40 are mounted in the stern 38*a* or/and on the buoyancy units 39, 39*a* to improve any rolling but also pitching of the watercraft 38 still further; said slosh plates are configured as large-sized as possible and do not interfere with the current against the body of a watercraft 38; and the slosh plates 40 can be, due to the buoyancy units 39 located on both sides, stretched continuously from one side of a watercraft 38 to the other, whereby they are also correspondingly easy to install. The otherwise horizontally disposed slosh plates 40, mounted over or next to the buoyancy units 39, can be easily bent downwards in the travelling direction as well, such that the sea water following behind does not press the stern 38*a* of the watercraft 38 downward by the pressure thereof. Also, the slosh plates themselves 40 are able to generate static or/and dynamic buoyancy, and they can be manufactured of metal or plastic.

It is understood that the scope of the invention is not limited to the shown and described embodiments.

LIST OF REFERENCE SIGNS

1 Stern hatch means
2 Back panel
3 Standing area, sector A which can be walked on
4 Lifting element
5 Pivot bearing device
6 Staircase, sector C which can be walked on
6*a* Water run-off
7 Gangway staircase, sector D which can be walked on
8 Foldout element
9 Step
10 Hand rail
11 Runner element set
12 Head standing area, sector B which can be walked on
13 Hinge
14 Hatch element
15 Spring
16 Walking area, sector E which can be walked on
17 Extension, sector F which can be walked on
18 Lifting means
19 Shaft
20, 20*a* Connecting wheel
21 Slotted toothing
22 Compression spring
23 Mounting screw
24 Load band
25 Gas spring
26 Block
26*a* Lifter
26*b* Toothed disc
27, Lift motor
27*a* Emergency lift motor

28 Rubber bearing
29 Hand tool
30 Remote control
31 Emergency lifting means
32 Swimming platform
33 Auxiliary transmission
34 Step ladder
35 Hand rail
36 Lock
37 Lever
38 Watercraft
38*a* Stern
39 Buoyancy unit
39*a* Adjustable buoyancy unit
40 Slosh plate
41 Emergency switch
42 Operating cylinder
43 Support elements
D Spring pressure direction

The invention claimed is:

1. A stern hatch device comprising:

a body that includes a first side and a second side opposite to the first side, wherein when the stern hatch device is attached to a watercraft:

the body in its entirety can pivot about a single axis at one end of the body between a closed configuration and an open configuration, the first side of the body includes a first sector that is exposed and includes an upper surface that is substantially horizontally positioned when the body is in the closed configuration such that a user can walk on the first sector on the first side of the body, the second side of the body includes a second sector that is exposed and includes an upper surface that is substantially horizontally positioned and does not represent a staircase when the body is in the open configuration such that the user can walk on the second sector on the second side of the body, the second side of the body includes a third sector that represents a staircase that is exposed and inclines downward when the body is in the open configuration and the upper surface of the second sector is substantially horizontally positioned such that the user can walk on the third sector on the second side of the body, the second sector and the third sector are covered when the body is in the closed configuration such that the user cannot walk on the second sector or the third sector, and the second sector is closer to the watercraft than the third sector when the body is in the open configuration.

2. The stern hatch device according to claim 1, wherein the first sector is on the first side of the body opposite to the second sector on the second side of the body.

3. The stern hatch device according to claim 1, further comprising a water run-off, a hatch element, a foldout element, a foldout hand rail, a runner element set, or the hatch element is folded at a time delay when the body is moved to the open configuration.

4. A watercraft comprising:

a watercraft body; and the stern hatch device according to claim 1, wherein:

the stern hatch device is attached to the watercraft body, and a swimming platform is located below the stern hatch device when the body is in the closed configuration, the stern hatch device and the swimming platform are connected to each other by a pivot bearing device, an emergency lifting device is located below the swimming platform at a position with a swing-out step ladder, activated by an emergency lift motor and an electrical switch or manually by levers, supported by a gas spring and a lock at a lift stop of a hand rail, which is activated by an auxiliary transmission, and in that the hand rail swings out faster and at a larger pivot angle in a same direction as the step ladder.

5. The stern hatch device according to claim 1, wherein, when the stern hatch device is attached to the watercraft, the body can move to an intermediate configuration between the open configuration and the closed configuration, or the body is activated by a sensor from the watercraft directly or via radio, or by a water-proof emergency switch on the body or on a swimming platform.

6. A watercraft comprising:

a watercraft body; and the stern hatch device according to claim 1, wherein:

the stern hatch device is attached to the watercraft body, and hydrodynamic buoyancy units are disposed below the stern hatch device and/or on a stern of the watercraft body, or slosh plates are mounted on the buoyancy units, and in that extendable or inflatable buoyancy units are located on the stern, and/or in that the buoyancy units are activated by a controller.

7. A watercraft comprising:

a watercraft body; and the stern hatch device according to claim 1, wherein:

the stern hatch device is attached to the watercraft body; and support elements are mounted below a swimming platform and connected to a stern of the watercraft.

8. A watercraft comprising:

a stern hatch device comprising:

at least three sectors that can be walked on, wherein at least one sector of the three sectors represents a staircase, one sector of the three sectors is located on an underside of the other sectors and the three sectors are configured to be pivoted as a whole above a pivot axis, or five sectors that can be walked on, wherein two sectors of the five sectors that can be walked on are located adjacently relative to each other and represent a staircase or a gangway staircase and the five sectors are configured to be pivoted as a whole about the pivot axis, or six sectors that can be walked on and of which an extension can be extended and the six sectors are configured to be pivoted as a whole about the pivot axis; and a swimming platform located below the stern hatch device, the stern hatch device and the swimming platform are connected to each other by a pivot bearing device, an emergency lifting device is located below the swimming platform at a position with a swing-out step ladder, activated by an emergency lift motor and an electrical switch or manually by levers, supported by a gas spring and a lock at a lift stop of a hand rail, which is activated by an auxiliary transmission, and in that the hand rail swings out faster and at a larger pivot angle in a same direction as the step ladder.

* * * * *